US005167285A

United States Patent [19]

Williams et al.

[11] Patent Number: 5,167,285

[45] Date of Patent: Dec. 1, 1992

[54] DRY POWDER AND LIQUID METHOD AND APPARATUS FOR EXTINGUISHING FIRE

[75] Inventors: Leslie P. Williams; Dwight Williams, both of Vidor, Tex.

[73] Assignee: CCA, Inc., Port Neches, Tex.

[21] Appl. No.: 672,943

[22] Filed: Mar. 21, 1991

[51] Int. Cl.[5] ..... A62C 31/07; A62C 31/12

[52] U.S. Cl. ..... 169/14; 169/15; 169/44; 169/70; 169/46; 169/47; 239/419.3; 239/423

[58] Field of Search ..... 169/44, 70, 14, 15, 169/46, 47, 69, 54, 62, 66, 68, 77; 239/428, 433, 419, 419.3, 423, 424.5, 427.3, 458

[56] References Cited

U.S. PATENT DOCUMENTS

| | | | |
|---|---|---|---|
| 1,148,763 | 8/1915 | Fagan | 169/44 |
| 2,292,794 | 8/1942 | Paradise | 169/46 |
| 2,853,139 | 9/1958 | Biro | 169/44 |
| 3,206,126 | 9/1965 | Thompson | 239/458 X |
| 3,313,353 | 4/1967 | Williamson et al. | 169/47 |
| 4,106,566 | 8/1978 | Dion-Biro | 169/44 |
| 4,640,461 | 2/1987 | Williams | 239/458 X |
| 4,669,548 | 6/1987 | Colodner | 169/70 X |

FOREIGN PATENT DOCUMENTS

| | | | |
|---|---|---|---|
| 2000598 | 7/1971 | Fed. Rep. of Germany | 169/70 |
| 1314995 | 6/1987 | U.S.S.R. | 169/44 |
| 2203065 | 10/1988 | United Kingdom . | |

*Primary Examiner*—Margaret A. Focarino
*Assistant Examiner*—James M. Kannofsky
*Attorney, Agent, or Firm*—Pravel, Gambrell, Hewitt, Kimball & Krieger

[57] ABSTRACT

A method and apparatus for extinguishing fires by simultaneously applying a spray of dry powder and liquid/liquid-foam, including a nozzle for the simultaneous spray of powder and liquid.

15 Claims, 7 Drawing Sheets

P
OA
C
L+F
M
L+F
OA
B1
L+F
L+F
L+F
B
B2
SUPPLY OF POWDER
P
L+F
L+F
L+F
SUPPLY OF L+F

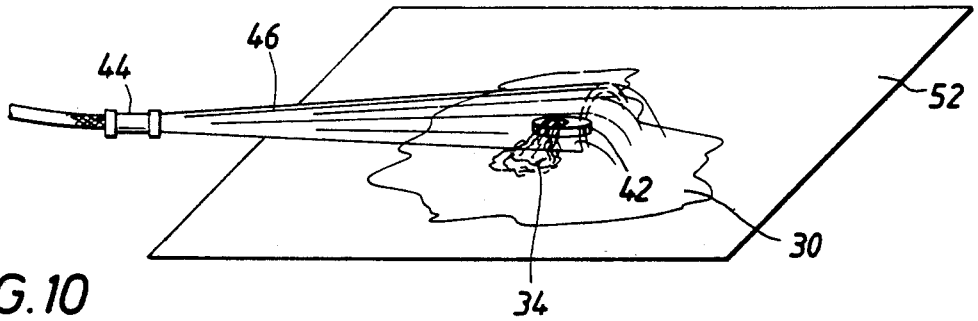
FIG. 10
FIG. 11
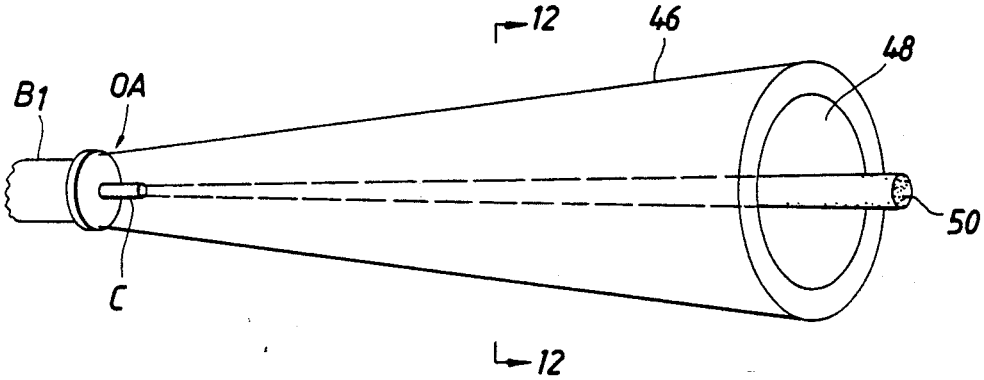
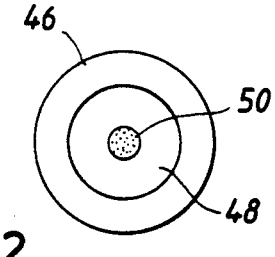
FIG. 12
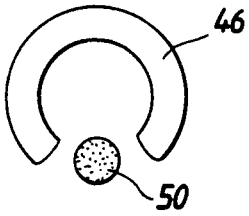
FIG. 13
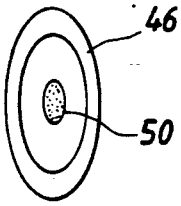
FIG. 14
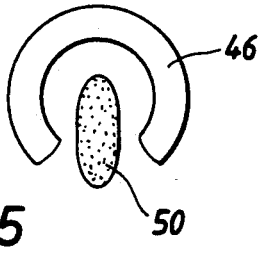
FIG. 15

DRY POWDER AND LIQUID METHOD AND APPARATUS FOR EXTINGUISHING FIRE

BACKGROUND OF THE INVENTION

The effectiveness of dry powders in extinguishing fires has been known for some time. Sodium bicarbonate, potassium bicarbonate, and potassium salt are some powders that have been used in fire extinction systems. Silicone may be added to the dry powder to aid in the powder's free flow. Even silicone alone has been used electively as a dry powder to extinguish fires.

The use of dry powder has at least two significant disadvantages. Dry powder is difficult to spray for any distance. Thus, the spraying nozzle must be drawn much closer to the fire itself. Further, a fire extinguished by powder has a definite propensity to reignite under common circumstances. If a three dimensional fire, in particular, has burned long enough to heat elements in its environment, such as metals, although the powder may extinguish the fire, it is likely to reignite when the powder dissipates.

The term two dimensional (or static) fire is used herein to indicate the combustion of a non-replenishing fluid or solid. An example of a two dimensional fire is the burning of a tank or pond that is not, or at least is no longer, being fed from a remote source. The term three dimensional (or dynamic) fire, by distinction, is used to refer to a fire that is fed by a remote replenishing source. A well blow out and a burning tanker (the burn area being fed by fluid from within) are examples of three dimensional, dynamic fires.

Dry powder is particularly useful in extinguishing a three dimensional fire. Liquids and liquid foam mixtures are particularly useful in extinguishing static, two dimensional fires, as well as in cooling and reducing the size of three dimensional fires. It is quite difficult, however, with liquid and liquid foam mixtures alone, to extinguish a three dimensional fire. The alternating use of powders and liquids on fires has been attempted. The difficulty with this technique is the degree of coordination required and the close approach to the fire required for the powder nozzle.

The present invention discloses a method and apparatus for applying simultaneously dry powder and liquid, or a liquid foam mixture, to a fire. The method and apparatus is particularly useful for the extinction of three dimensional fires, together with their associated static fires. The method and apparatus achieves not only the advantage of permanently extinguishing a three dimensional fire but also the enhanced safety of permitting operation from a greater distance by extending the distance over which dry powder can be effectively sprayed.

SUMMARY OF THE INVENTION

The invention disclosed herein is both a method and an apparatus for extinguishing fires, and in particular, three dimensional fires. The method comprises applying to the fire, simultaneously, a stream of powder surrounded by a stream of liquid. In the preferred embodiment, the liquid includes a foaming composition. Preferably, the foaming composition would be a film-forming foam.

The word "surrounded" as used herein is not intended to imply "completely surrounded." "Substantially surrounding" the stream of powder by the stream of liquid is effective. Examples of "surrounding" by "substantially surrounding" are covered below.

In the preferred embodiment, the flow path of the liquid stream assumes the shape of a hollow cone. The flow path of the powder stream lies within the hollow cone. It has been found that by so enclosing the powder stream within the liquid stream, the capacity to throw the powder stream is significantly enhanced.

In the method of the preferred embodiment, an initial liquid stream is preferably first applied to a three dimensional fire. The stream is initially sprayed in a broad pattern so that it encapsulates the fire, to the extent possible. During this time, associated static fires, such as from pools that may lie at the feet of the dynamic fire, should be extinguished. The liquid stream also cools and reduces the dimensions of the three dimensional fire. As the dimensions of the three dimensional fire reduce, the breadth of the liquid spray is reduced. The preferred embodiment applies the powder stream to the fire after the fire has been cooled and diminished substantially by the initial liquid stream. When the powder stream is applied, it is contained within the hollow cone of the liquid stream. The powder acts on the cooled and reduced fire that is continuously and simultaneously being encapsulated by the liquid stream. Applying the powder stream within the hollow of a liquid stream not only enables the powder stream to be thrown further, but, by continuously and simultaneously applying the liquid stream, prevents the re-ignition of the static or dynamic portions of the fire.

The invention discloses a joint liquid and powder nozzle for extinguishing fires. The nozzle comprises a barrel with an axial bore, the bore having an inlet for receiving a liquid stream under pressure and an outlet area through which the liquid stream is thrown, or discharged. In the present invention, a powder conduit is connected to the barrel. The conduit has an inlet for receiving powder and an outlet through which the powder is discharged. The conduit is affixed to the barrel in a manner such that the outlet for the powder is located to effect the powder being discharged in a path substantially surrounded by the path of the discharged liquid stream.

In the preferred embodiment, the liquid stream is discharged from the barrel around an obstruction centered within the axial bore. Typically the obstruction takes the form of a plate of smaller diameter than the axial bore. The discharge pattern of the liquid stream in such case assumes that of a hollow cone. It should be understood that the nozzle is typically adjustable, so that the walls of the hollow cone can be adjusted to diverge, converge, or parallel each other.

In one embodiment, the powder conduit is attached to the exterior of the barrel, with a portion carrying the outlet intersecting the liquid stream itself. Alternately, portions of the conduit are mounted within the axial bore itself. Both means suffice to locate the outlet area of the conduit with respect to the outlet area of the barrel such that the stream of powder is discharged substantially surrounded by the disclosed liquid stream.

When a foaming composition is combined with the liquid, either the liquid and the foaming composition can be supplied to the nozzle already mixed, or the nozzle itself can form a means for mixing the foaming composition and the liquid. In the latter case, the nozzle can include an eductor means attached within the axial bore. The eductor means communicates with a mixing chamber located in the barrel outlet area and that discharges into that area. The eductor has an inlet to receive a portion of the entering liquid stream from the barrel in order to create a reduced pressure chamber. A second inlet of the eductor receives a foam-forming composite. The liquid stream and foam-forming composite are delivered to the mixing chamber wherein the mixture is aerated to form the proper foam and is discharged.

In the preferred embodiment, the barrel of the nozzle is comprised of two parts. A forward portion telescopically slides over a rearward portion. By telescopically sliding the two portions of the barrel over each other, the shape of the outlet area, and thus the shape of the discharged liquid stream, can be varied.

BRIEF DESCRIPTION OF THE DRAWINGS

FIGS. 6 through 10 illustrate the method of this invention as applied to a three dimensional fire.

FIG. 11 illustrates one pattern for the liquid stream and the powder stream.

FIG. 12 is a cross-sectional view of the liquid stream and powder stream as discharged from a nozzle of the present invention.

FIGS. 13 through 15 illustrate other cross-sectional views of simultaneous streams of powder and liquid in accordance with this invention.

DESCRIPTION OF THE PREFERRED EMBODIMENTS

Figure 6:
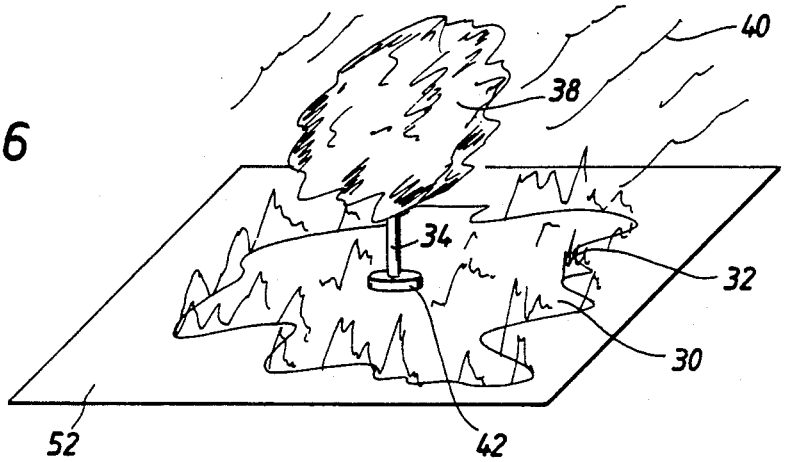
Figure 7:
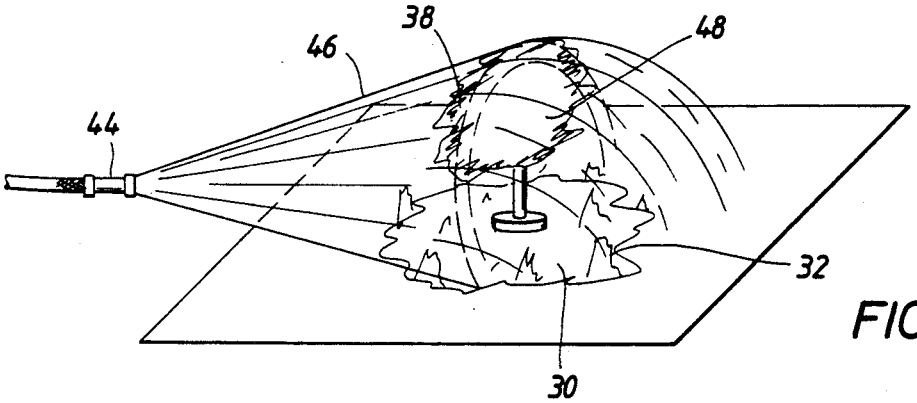
Figure 8:
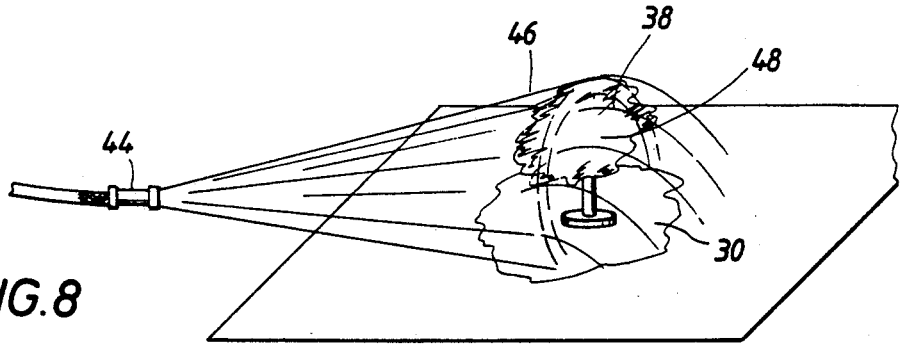
Figure 9:
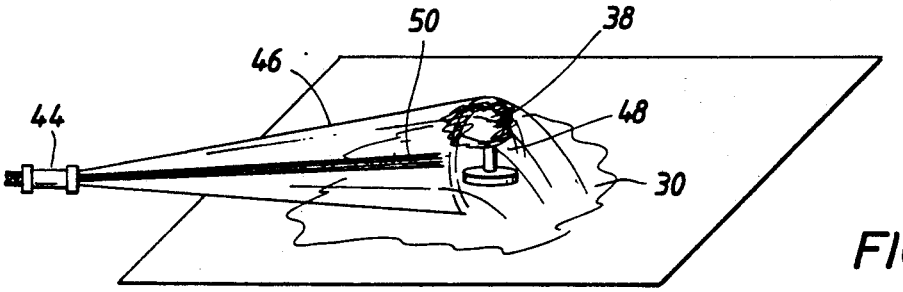

FIGS. 6 through 10 illustrate a preferred embodiment of the method of the present invention. FIG. 6 illustrates a three dimensional fire with an associated static fire. FIG. 6 might be taken to illustrate a well blowout. Combustible fluid 34 is spewing through outlet 42 under pressure from a remote source. The fire or combustion 38 of the fluid rises in the air, generating smoke 40. Pool 30 of the fluid forms on ground 52 and is encompassed by flames 32. In FIG. 7 nozzle 44 is brought to the three dimensional fire. A broad spray 46 of liquid, or preferably liquid with a film forming foam composite, is applied to the fire in a breadth sufficient to encapsulate the fire. The liquid spray is shown applied, in this embodiment, as a hollow cone. FIG. 7 indicates the hollow area of the cone. Upon the application of the liquid spray the static fire 32 of pool 30 diminishes. FIG. 8 illustrates that the spray of liquid foam has extinguished static fire 32 in pool 30 and has diminished the size of the three dimensional fire with combustion area 38. FIG. 8 also illustrates that the breadth of the liquid spray 46 has been reduced as the extent of the three dimensional fire has reduced. Liquid spray 46 is still being thrown in a configuration with a hollow center 48. FIG. 9 illustrates the application of dry powder spray 50, discharging from nozzle 44 through the hollow center of a continuous liquid spray 46. The static fire from pool 30 remains extinguished. The dry powder spray is directed to the diminished combustion portion 38 of the three dimensional fire. FIG. 10 illustrates ground area 52 with the fire extinguished. Liquid spray 46 continues to be applied to pool 30 and surging fluid 34, that now adds to pool 30. However, there is no more combustion, or fire.

FIGS. 1 through 5 illustrate five different embodiments of a nozzle for the simultaneous application of dry powder and liquid/liquid-foam. The nozzle is comprised of barrel B, made up of two portions B1 and B2. B1 telescopically slides over B2 from its left-most and most open position, shown, to its right-most and most closed position, where stop 62 abuts shoulder 64. With B1 in its left-most position, liquid spray LF is discharged in the broadest pattern. With the barrel in its right-most position, liquid spray LF is discharged in its narrowest pattern. Conduit C contains an inlet 66 and outlet area 68. Dry powder is supplied in the inlet and discharged from the outlet. A major portion of conduit C is approximately aligned with the axis of the barrel. In the preferred embodiment the dry powder is supplied to the nozzle under pressure. Liquid L enters the barrel of the nozzle from the left and proceeds generally through the barrel from left to right around structural obstructions. A portion of the Liquid L1 flows through inlet 71 of eductor system E. Eductor system E is located within the center of the axial bore, surrounding conduit C. Liquid L1 that flows through eductor E enters chamber 70. In chamber 70, the reduction in pressure aids to pull foam concentrate F from an external source through conduit 72 and into the eductor chamber. The liquid L1 and foam concentrate F mix and flow through channel 74 surrounding a portion of the powder conduit. The fluid L1 plus the foam F enter mixing chamber M. Additional liquid L2 may enter mixing chamber M through ducts D in obstruction O. The liquid and foam exit mixing chamber M at outlets 80. This liquid and foam mixture mixes with the remainder of the liquid flowing through the outer portion of the axial bore of the barrel. The total liquid and foam mixture is discharged from the outlet area OA of the barrel. The direction of discharge is toward the right in the drawing. Obstruction O associated with mixing chamber M is located in the approximate center of the barrel in the outlet area OA of the barrel. Obstruction O, together with mixing chamber M in the preferred embodiment, cooperate with the barrel such that the liquid foam stream LF discharged from the barrel is discharged in the configuration of a hollow cone.

Figure 1:
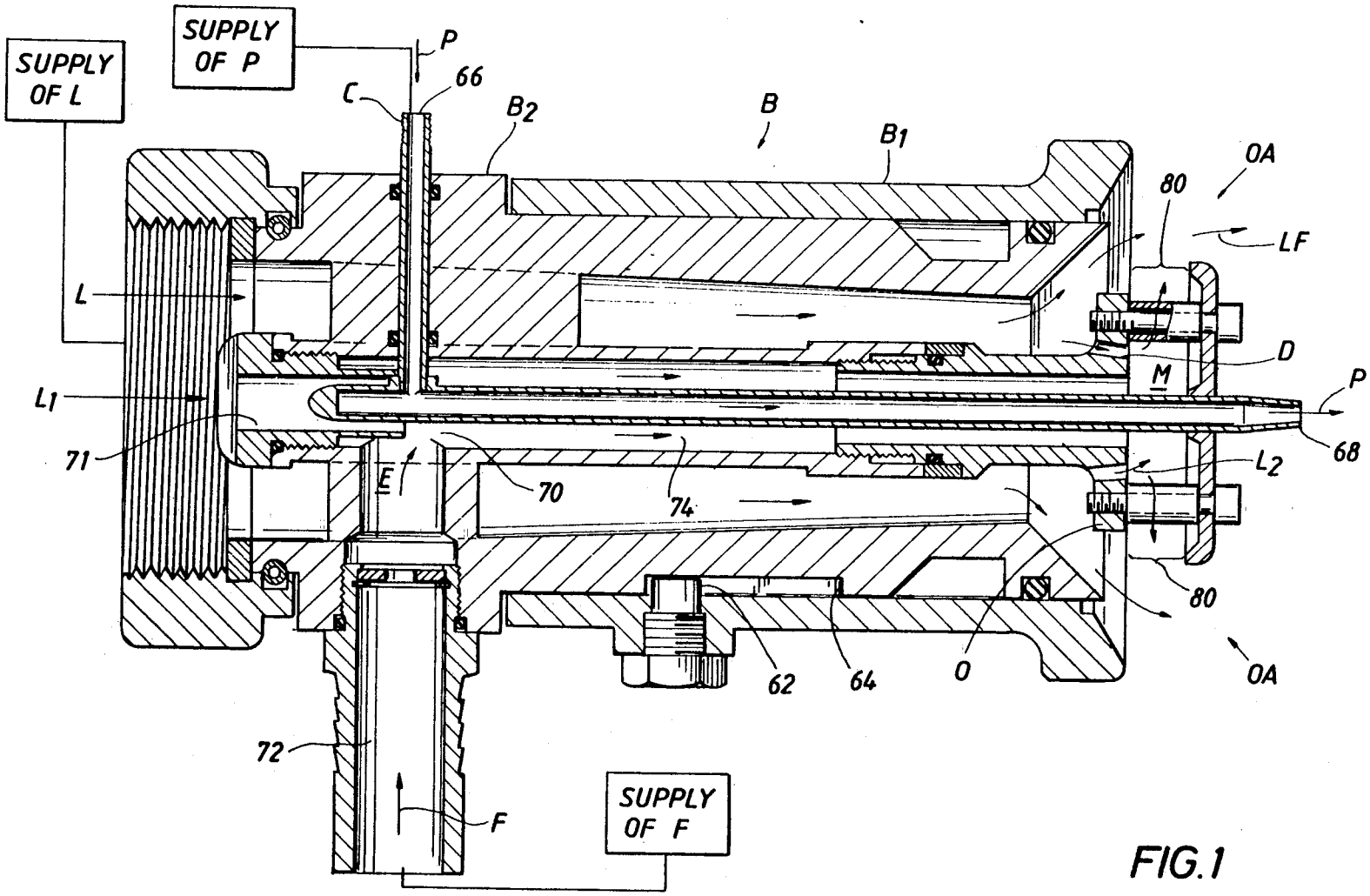
FIG. 1 is a cross-sectional view of one embodiment of the liquid and powder nozzle.
Figure 2:
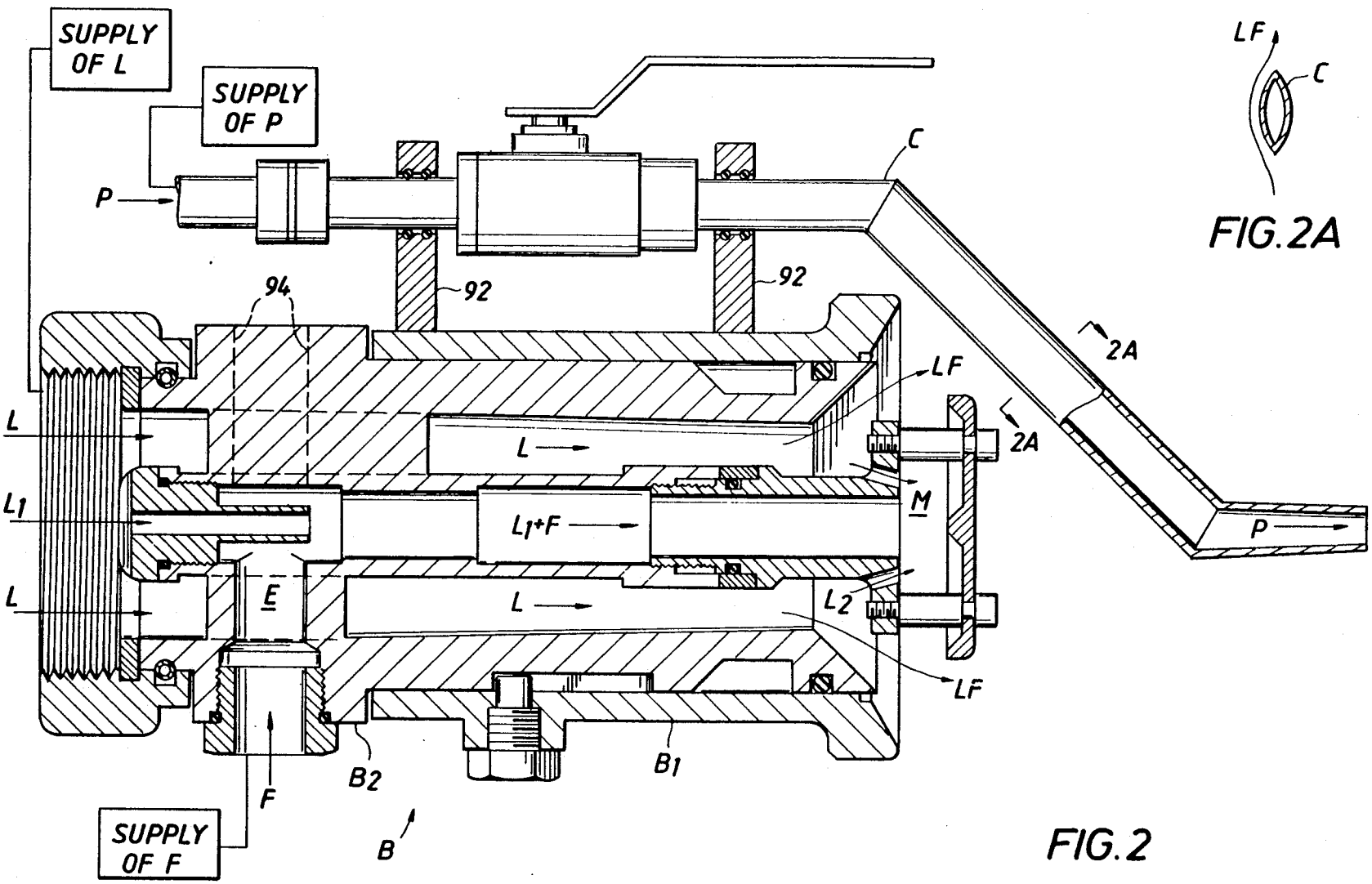
FIG. 2 is a cross-sectional view of a second embodiment of the liquid and powder nozzle.

FIG. 2 is an alternate embodiment of the liquid and powder nozzle. FIG. 2 differs from FIG. 1 predominantly in that the powder conduit C is attached by means 92 to the outside of barrel B. In particular, conduit C is attached to portion B1 of barrel B. Dashed lines 94 indicate in FIG. 2 that foam need not be educted by the eductor through only one conduit. Indeed, foam concentrate F can be educted through multiple conduits or a continuous conduit. FIG. 2A illustrates the preferred design of a portion of conduit C that intersects discharging liquid foam mixture LF. FIG. 2A illustrates that, preferably, conduit C at this portion would have an aerodynamic design such that the liquid foam stream would flow around the conduit in a path of least resistance and least turbulence.

Figure 3:
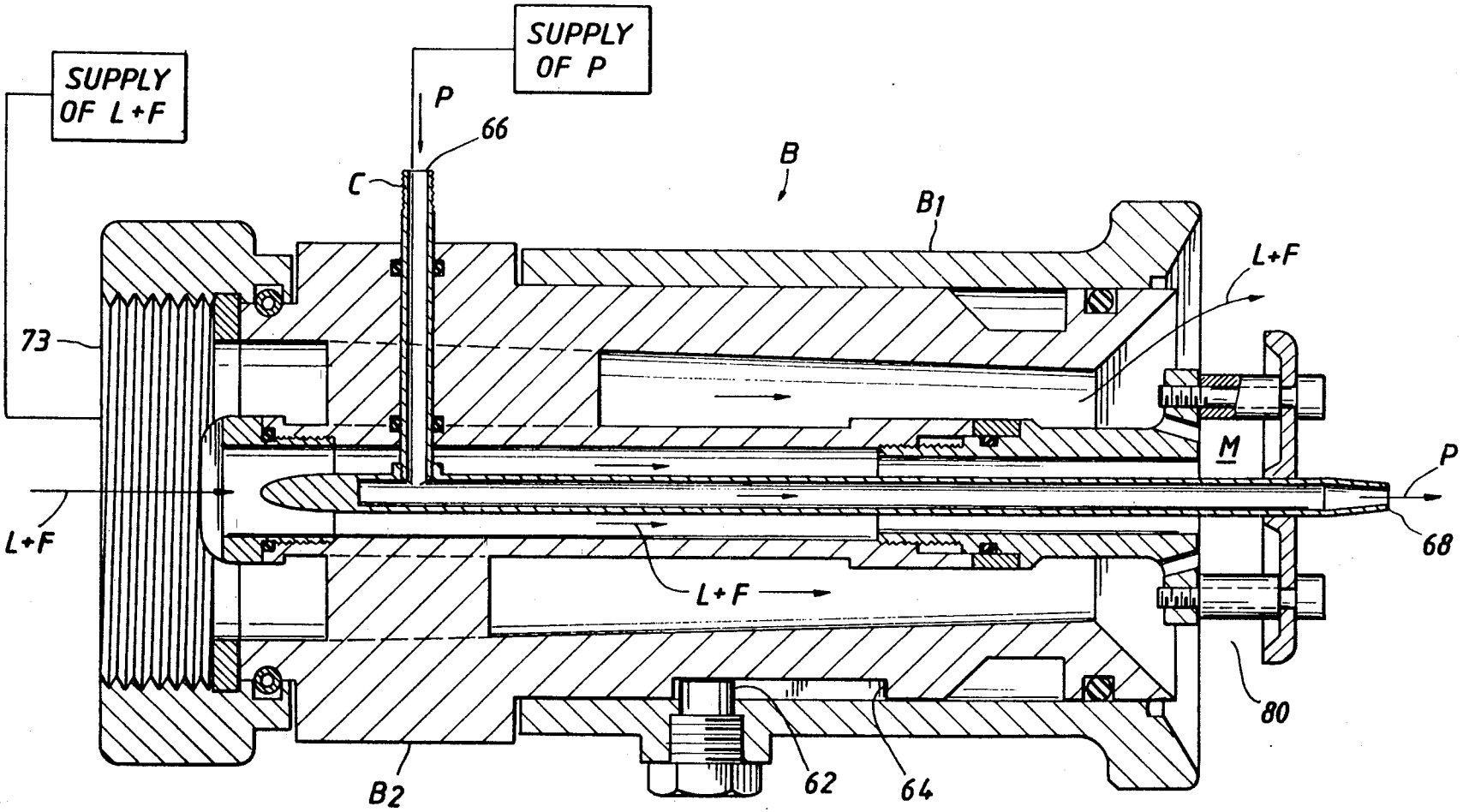
FIG. 3 is a cross-sectional view of a third embodiment of the liquid and powder nozzle.

FIG. 3 illustrates an embodiment of the invention wherein the liquid and foam concentrate F have already been combined before they enter the barrel at inlet 73 on the left of B2. The liquid and foam combination may continue to flow in an inner path through the axial bore to mixing chamber M wherein a portion of the liquid and foam mixture is further aerated before joining the portion of the liquid and foam mixture that passes through the outer areas of the axial bore. In FIG. 3, as in FIG. 1, the powder is supplied to conduit C that contains a portion substantially aligned with the center of the axial bore of the barrel.

Figure 4:
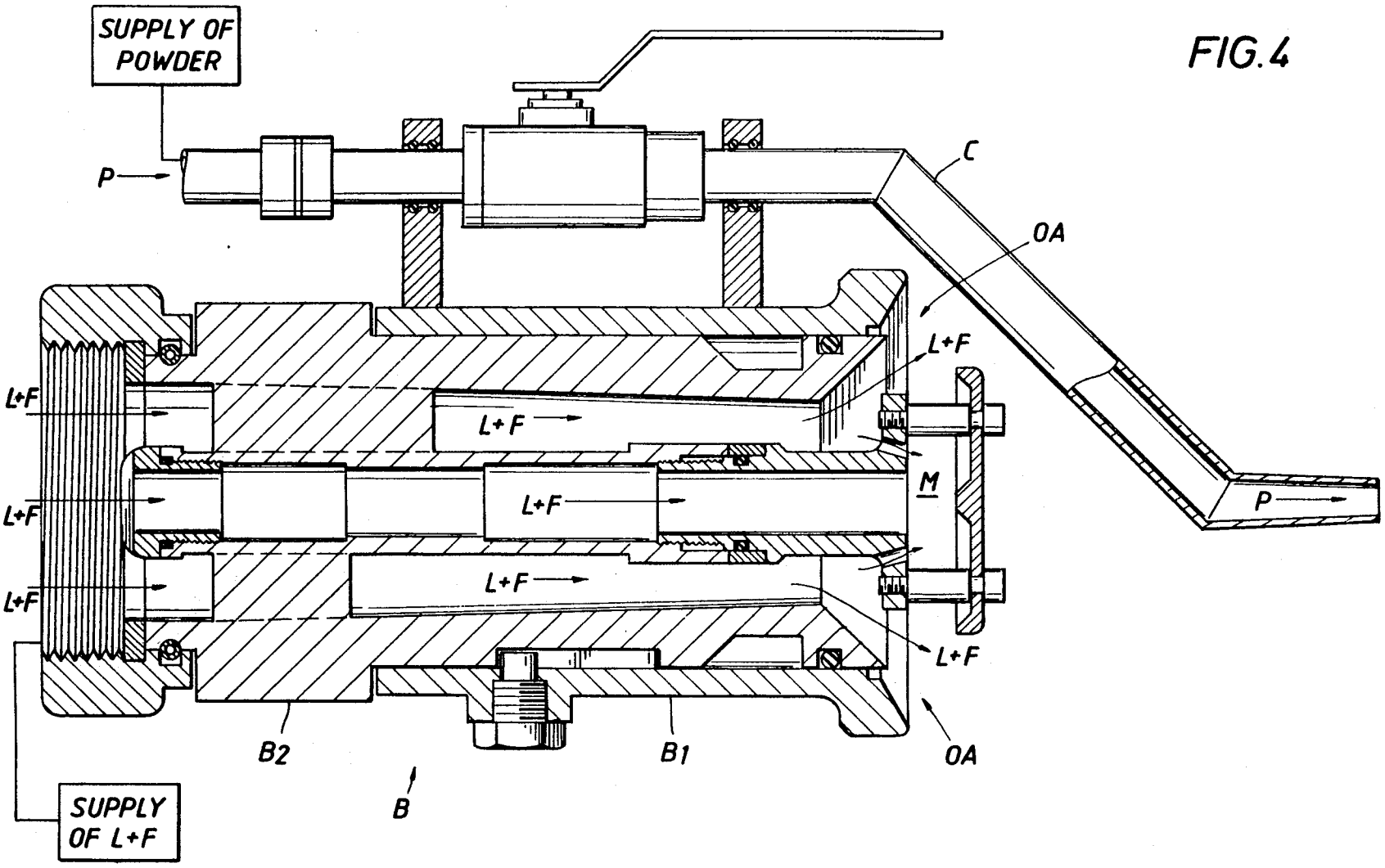
FIG. 4 is a cross-sectional view of a fourth embodiment of the liquid and powder nozzle.

The embodiment of FIG. 4 is like the embodiment of FIG. 3 in that the liquid L and foam concentrate F is supplied to the nozzle already mixed. The embodiment of FIG. 4 is like the embodiment of FIG. 2 in that the powder conduit C is affixed to the exterior of forward barrel B1. Again, since conduit C itself intersects the liquid and foam spray emerging from the outlet area OA of nozzle, preferably conduit C embodies an aerodynamic design at least for the portion in which the conduit intercepts the liquid spray being discharged.

Figure 5:
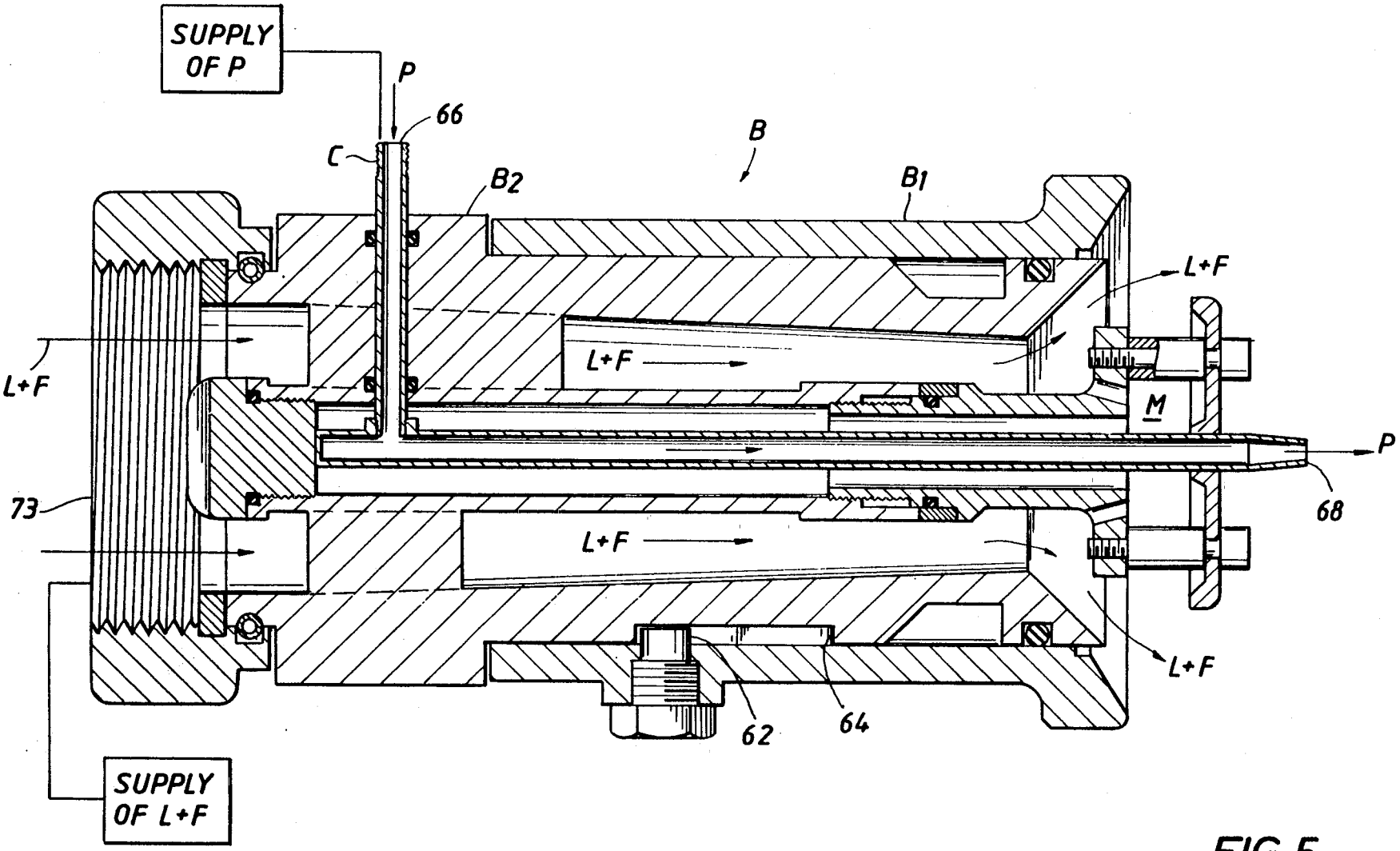
FIG. 5 is a cross-sectional view of a fifth embodiment of the liquid and powder nozzle.

The embodiment of the nozzle illustrated in FIG. 5 is like the embodiment of FIG. 3. That is, the liquid L and foam concentrate F are supplied already mixed to the inlet area 73 to the left on barrel portion B2 in the embodiment of FIG. 5. The liquid and foam, however, do not pass through a central portion surrounding the powder conduit C in the axial bore.

FIG. 11 illustrates a preferred pattern for the simultaneous discharge of powder spray 50 and liquid/liquid-foam spray 46. FIG. 11 illustrates the pattern whereby powder spray 50 is discharged and thrown within the center 48 of a hollow cone comprising the liquid spray 46. FIG. 12 illustrates this configuration in cross-section. FIGS. 13, 14, and 15 illustrate that liquid spray 46 need not absolutely "surround" powder stream 50. As FIG. 13 suggests, liquid spray 46 could be thrown such that its cross-section comprised a part of a ring. Powder stream 50 could occupy space in the ring area not occupied by the liquid stream. FIG. 15 illustrates that the powder stream need not have a circular cross-section but could have an oval cross-section. FIG. 14 illustrates that the liquid stream 46 could have an oval figuration. Since nozzles usually employ circular barrels and circular obstructions, it is anticipated that the easiest hollow liquid/liquid-foam spray to throw would be that of a hollow cone.

Having described the invention above, various modifications of the techniques, procedures, material and equipment will be apparent to those in the art. It is intended that all such variations within the scope and spirit of the appended claims be embraced thereby.

We claim:

1. A liquid and powder method for the extinction of three dimensional fires, comprising applying to the fire simultaneously a stream of powder surrounded by a stream of liquid.

2. The method of claim 1, wherein the flow path of the liquid stream assumes the shape of a hollow cone and wherein the flow path of the powder stream lies within the hollow cone.

3. The method of claim 1, wherein the liquid includes a foam.

4. The method of claim 3, wherein the foam comprises a film forming foam.

5. The method of claim 1, which further comprises applying to the fire an initial liquid stream without a powder stream.

6. The method of claim 5 that further comprises applying the initial liquid stream in a broad spray to encapsulate the fire.

7. The method of claim 6 that further comprises reducing the breadth of the initial stream as the volume of the three dimensional fire diminishes.

8. A liquid and powder nozzle for fire extinction, comprising a barrel having an axial bore with an inlet portion for receiving a liquid stream under pressure and an outlet area through which a liquid stream is discharged;

a conduit attached to the barrel, having an inlet for receiving powder and an outlet area;

means for supplying liquid to the axial inlet portion;

means for supplying powder to the powder conduit inlet; and barrel-outlet/conduit-outlet relative location means for discharging a powder from the conduit in a path substantially surrounded by a path of a liquid stream discharged from the barrel.

9. The nozzle of claim 8, wherein the conduit is affixed to the exterior of the barrel and wherein a portion of the conduit intersects a flow path of the discharged liquid stream.

10. The nozzle of claim 8, wherein the barrel outlet area includes an obstruction mounted within the axial bore such that the liquid stream is obstructed from discharging from a portion of the axial bore.

11. The nozzle of claim 10, wherein a portion of the conduit is located in approximate axial alignment with the axis of the bore.

12. The nozzle of claim 10, wherein the barrel is comprised of a forward portion that telescopically slides over a rearward portion such that the shape of the barrel outlet area can be varied.

13. The nozzle of claim 10, wherein the obstruction comprises a plate of smaller diameter than the bore and located centrally within the bore such that the liquid stream discharged from the outlet area around the obstruction assumes the shape of a substantially hollow cone.

14. The nozzle of claim 13, wherein the outlet area of the conduit is located such that the powder is discharged in a path that flows within the hollow portion of the cone.

15. A liquid and powder nozzle for fire extinction, comprising a barrel having an axial bore with an inlet portion for receiving a liquid stream under pressure and an outlet area through which a liquid stream is discharged;

a conduit attached to the barrel, having an inlet for receiving powder and an outlet area;

barrel-outlet/conduit-outlet relative location means for discharging a powder from the conduit in a path substantially surrounded by a path of a liquid stream discharged from the barrel;

eductor means attached within the axial bore for educting a foam composite into the nozzle, the eductor means having a first inlet to receive a portion of the liquid stream to create reduced pressure in the eductor and a second inlet to receive the foam forming composite; and a mixing chamber communicating with the eductor means and located in and discharging into the barrel outlet area.

* * * * *